US005609920A

United States Patent [19]

Riepenhausen

[11] Patent Number: 5,609,920

[45] Date of Patent: Mar. 11, 1997

[54] METHOD OF AND APPARATUS FOR COATING AT LEAST ONE LIQUID MEDIUM ONTO A MOVING MATERIAL WEB, IN PARTICULAR OF PAPER OR CARDBOARD

[75] Inventor: Bernd Riepenhausen, Heidenheim, Germany

[73] Assignee: Voith Sulzer Papiermaschinen GmbH, Heidenheim, Germany

[21] Appl. No.: 430,369

[22] Filed: Apr. 28, 1995

[30] Foreign Application Priority Data

Apr. 28, 1994 [DE] Germany ..... 44 14 921.2

[51] Int. Cl.[6] ..... B05D 1/28

[52] U.S. Cl. ..... 427/428; 427/421; 118/206; 118/262; 118/235; 118/405; 118/407; 118/414; 118/412; 118/413

[58] Field of Search ..... 427/428, 421; 118/206, 262, 405, 407, 414, 412, 413, 235

[56] References Cited

U.S. PATENT DOCUMENTS 4,259,921 4/1981 Wallsten ..... 118/206

FOREIGN PATENT DOCUMENTS 2949840 7/1980 Germany .

4014647 11/1991 Germany .

*Primary Examiner*—Shrive Beck
*Assistant Examiner*—David M. Maiorana
*Attorney, Agent, or Firm*—Sughrue, Mion, Zinn, Macpeak & Seas

[57] ABSTRACT

A method of coating at least one liquid medium onto a moving material web, in particular of paper or cardboard, in which method the material web is led either in a first mode of operation along a first treatment path or, in a second mode of operation, along a second treatment path, the material web being led along the first treatment path through a roll gap formed by a primary roll and a secondary roll for indirect coating of the liquid medium via the shell surface of the primary roll, or along the second treatment path over a region of the shell surface of the primary roll remote from the roll gap for directly coating the liquid medium onto the material web in the mentioned region of the shell surface of the primary roll, wherein the primary roll is driven in the one rotational direction in the first mode of operation and in the other rotational direction in the second mode of operation, and the respective general run-in and run-out direction for the material webs is substantially the same in the region of the primary and the secondary rolls along both treatment paths.

16 Claims, 4 Drawing Sheets

METHOD OF AND APPARATUS FOR COATING AT LEAST ONE LIQUID MEDIUM ONTO A MOVING MATERIAL WEB, IN PARTICULAR OF PAPER OR CARDBOARD

BACKGROUND OF THE INVENTION

The present invention relates to a method of coating at least one liquid medium onto a moving material web, in particular of paper or cardboard, in which method the material web is led along a first treatment path in a first mode of operation or along a second treatment path in a second mode of operation, the material web being led a) along the first treatment path through a roll gap formed by a primary roll and a secondary roll to indirectly apply the liquid medium via the shell surface of the primary roller, or b) along the second treatment path over a region of the shell surface of the primary roller remote from the roll gap to directly apply the liquid medium on the material web in the mentioned region of the shell surface of the primary roller.

The invention also relates to an apparatus for carrying out this method.

Processing methods and apparatus of the type described above are already generally known. Thus, for example, DE-OS 40 14 647 discloses a processing method and apparatus which are designed in such a manner that the general run-in and run-out direction of the first treatment path is approximately at right angles in the region of the primary and secondary rolls to the general run-in and run-out direction of the second treatment path. In such a concept, the coating mechanisms and devices required for coating the liquid medium can be arranged optimally and in an easily accessible manner in the area of the primary and secondary rolls which are equipped with simple drives. However, this concept must be paid for dearly with a relatively large number of web guide rolls arranged upstream and downstream of the primary and secondary rolls and a not insignificant additional input of technical resources for the web feed.

SUMMARY OF THE INVENTION

It is the object of the present invention to further develop a processing method and apparatus of the type initially described in such a manner that the technical input for the guiding and feeding of the respective material web can be reduced without incurring operative disadvantages.

This object is solved in accordance with the invention by a processing method which is characterized in that the primary roll is driven in the one rotational direction in the first mode of operation and in the other rotational direction in the second mode of operation, and the general run-in or run-out direction of the material webs in the region of the primary and secondary rolls is essentially the same along both treatment paths.

An advantageous apparatus for carrying out the method is characterized for solving the object in that a drive with a rotational direction reversal is provided for the primary roll, and the web guide rolls are arranged in such a manner in the run-in and run-out region of the primary and secondary rolls that they guide the material webs along both treatment paths.

On account of the new processing method and apparatus, the general web guidance in the vicinity of the primary and secondary rolls follows a unitary basic direction along both treatment paths. The respective material web is guided along the first treatment path on the one side and along the second treatment path on the other side of the primary roll. The run-in and run-out paths of the material web in the region of both rolls is, however, essentially the same with respect to direction for the run-in and run-out of both treatment paths so that a comparatively small number of web guide rolls suffices for guiding the web and, in particular, the technical input for the web feed can be considerably reduced.

The comparatively small number of web guide rolls can be put down to the fact that, on account of the unitary run-in and run-out direction for the material webs along both treatment paths, the web guide rolls predominately have a double-function, i.e. they function in both modes of operation. The reduction in the technical input for the web feed also results from the unitary run-in and run-out paths which only require small change-over work and not a complete rebuilding and adjustment to another path guidance. This circumstance also leads to a considerable simplification in the procedure for the web feed itself.

In comparison to the known arrangement according to DE-OS 40 14 647, a change in the rotational direction is necessary for the primary roll to change over from a first treatment path to the second treatment path and vice versa. However, the technical input required for this measure is hardly significant compared to the attained advantages as described above, since use can be made in this case of known and tested technical solutions.

On account of the unitary run-in and run-out paths for the material web along both treatment paths and the double-function of the web guide rolls, relatively short distances can be realized, and in fact between those positions at which the material web, with reference to the primary roll, branches off on the run-in side from the first to the second treatment path and, on the run-out side, is moved together again. This in itself makes a relatively compact mode of construction and a reduction in the structural space requirement possible. In certain cases (such as in an arrangement as is known from DE-OS 40 14 647), this results in the possibility of being able to use downstream driers for both modes of operation.

Tests have shown that in the case of the first mode of operation in which the material web is led along the first treatment path through a roll gap formed by the primary roll and the secondary roll, there exists the reduced risk of so-called web tears. This leads to an increase in the so-called "running efficiency". However, when coating the liquid medium along the first treatment path, as is known, a lower coating quality must be reckoned with.

In the case of the second mode of operation, i.e. a direct coating of the liquid medium onto the material web along the second treatment path, one must reckon on the basis of experience with a higher risk of web tears. However, the treatment along the second treatment path result, as is known, in a higher coating quality.

Therefore, depending on the selection of the treatment path, the one or other advantage can be also used with the processing method according to the invention.

It is an advantage if the material webs in the run-in to the primary roll and after the run-out from the primary roll are respectively led over a web guide roll located as close as possible to the primary roll. On account of this, the unit can be built very compactly, which has a positive effect on the space requirement. Additionally, the adjoining hot air drier can be used in such an arrangement for drying along both treatment paths.

A very good guidance and contact of the material web on the primary roll is achieved when, the material web is guided in such a manner over the upstream web guide roll that this rotates respectively in the opposite direction to the rotational direction of the primary roll in each of the two modes of operation.

BRIEF DESCRIPTION OF THE DRAWINGS

In the following, for further explanation and better understanding of the invention, the method of coating the liquid medium as well as the apparatus for carrying out the method are described in more detail on the basis of an example of a coating unit with reference to the enclosed drawings, in which.

DETAILED DESCRIPTION OF THE INVENTION

Figure 1:
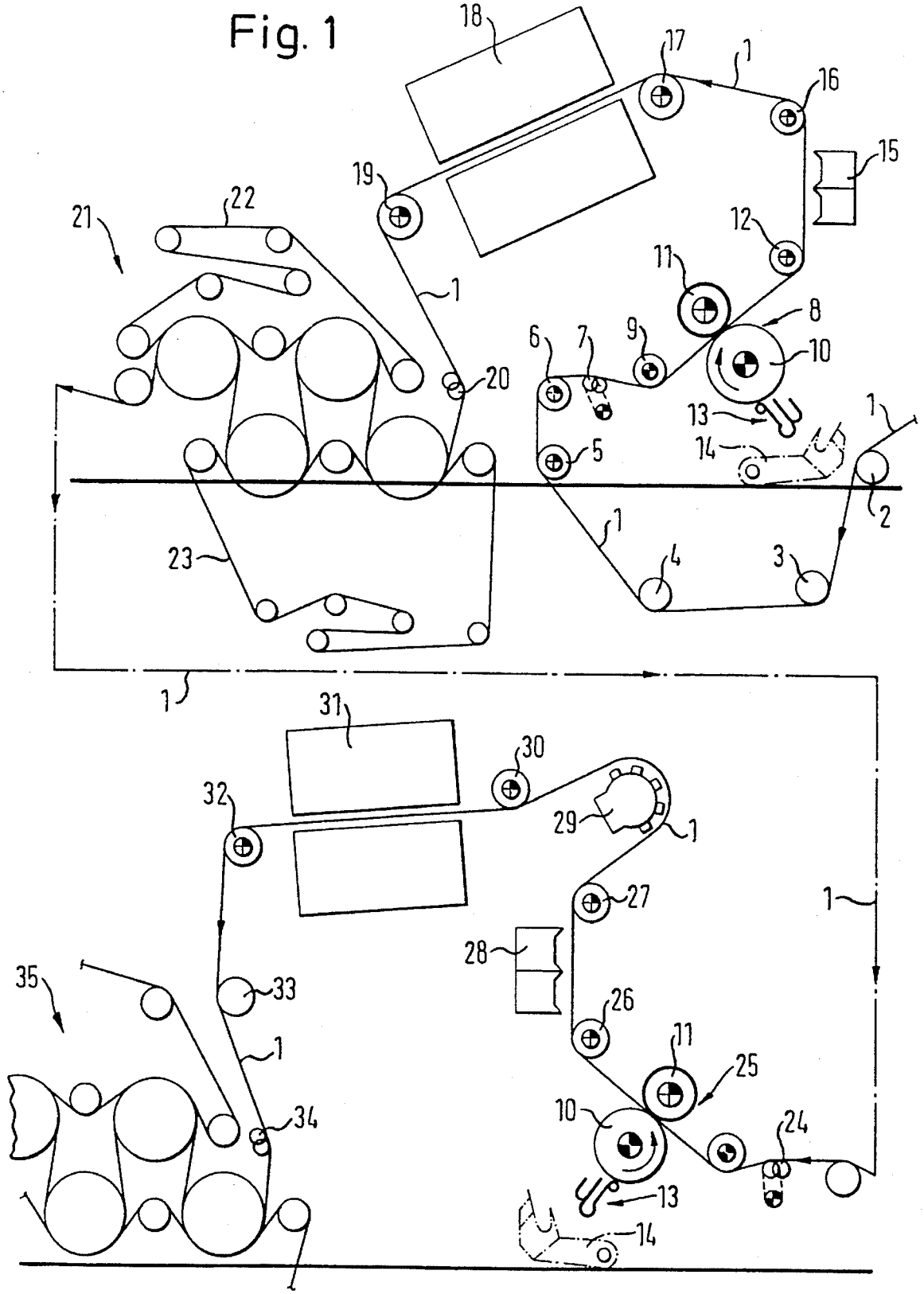
FIG. 1 schematically shows an entire unit which operates in a first mode of operation in which a material web passes through the unit along a first treatment path, FIG. 2 schematically shows the entire unit according to FIG. 1, but in a second mode of operation in which the material web passes through the unit along a second treatment path, FIG. 3 schematically shows a part of the entire unit according to FIG. 1 in a first mode of operation, but with different coating stations in comparison to the exemplary embodiment of FIG. 1.
Figure 2:
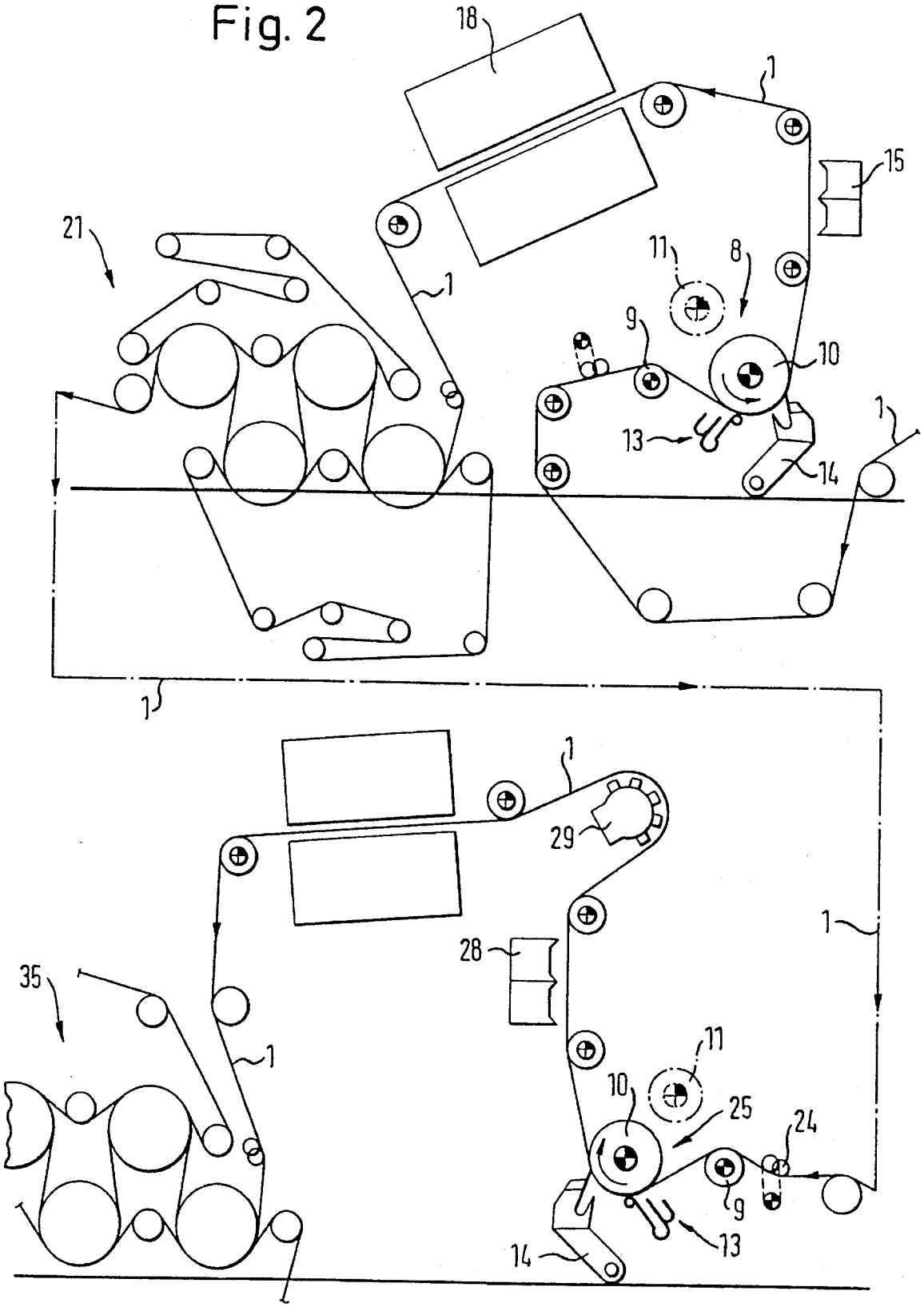

As FIGS. 1 and 2 show, the material web 1 enters over web guide rolls 2 to 6 and a so-called width tightening roll 7 into the region of a first coating station 8. This first coating station 8 includes at the run-in side a web guide roll 9, a primary roll 10, a secondary roll 11 lying opposite this and, at the run-out side, a web guide roll 12.

The first coating station 8 additionally includes a nozzle coating mechanism 13 and a precision dosing blade beam 14 which is not in operation according to FIG. 1 in the case of the first mode of operation and is therefore indicated in FIG. 1 merely with dot- dash lines in its retracted position.

After leaving the first coating station 8, the material web 1 passes an infra red drier 15 (briefly referred to in the following as IR-drier) after the web guide roll 12 and is then guided via web guide rolls 16 and 17 through a first hot air drier 18. After leaving the first hot air drier 18, the material web 1 enters via a web guiding roll 19 and a second width tightening roll 20 into a first contact drying cylinder arrangement 21 of known construction. This arrangement has a number of drying cylinders against which the material web 1 is pressed in a known manner by means of a so-called top felt 22 and a bottom felt 23.

After leaving the first contact drying cylinder arrangement 21, the material web enters the region of a second coating station 25 via further web guide rolls, which are not shown, and a width tightening roll 24. This second coating station 25 is structured in the present exemplary embodiment in a substantially mirrored form compared to the first coating station 8. It has a primary roll 10, a secondary roll 11 and a nozzle coating mechanism 13 as well as a precision dosing blade beam 14. After leaving the second coating station 25, the material web 1 passes a further IR-drier 28 between web guide rolls 26 and 27 and is subsequently led via a contactlessly operating deflection device 29 of known construction and a web guide roll 30 to a second hot-air drier 31.

After leaving the second hot-air drier 31, the material web 1 is supplied via web guide rolls 32 and 33 and a further width tightening roll 34 to a second contact drying cylinder arrangement 35 which is structured in a similar manner as the first contact drying cylinder arrangement 21 and, for simplicity, is only partially illustrated in the FIGS. 1 and 2.

As is common in such units, the first coating station 8 serves to treat a first side (for example, the so-called top side) of the material web, which is then dried to the required degree by means of the IR-drier 15 and the first hot air drier 18 as well as the first contact drying cylinder arrangement 21.

In the second coating station 25, the other side (for example, the so-called under side) of the material web 1 is treated, the drying of which then ensues via the IR-drier 28, the second hot air drier 31 and the second contact drying cylinder arrangement 35.

In units of the described kind, at least a portion of the rolls must be driven. Which rolls require a drive and in which manner the control of these drives ensues is well known to the skilled person and therefore not described in more detail in connection with the unit illustrated in the figures. Only in the region of the first coating station 8 and of the second coating station 25 are the roll drives denoted with symbols arranged in the centre of the rolls or beside the rolls. In this case, the symbol ⊕ denotes a roll which can only be driven in one direction. The symbol ◐ denotes a drive by means of which the respective roll can be driven in two directions.

In the units illustrated in the drawings, the respective primary rollers 10 of the first coating station 8 and of the second coating station 25 are equipped with such a drive in both directions. The possibility of driving in both directions represents an essential feature of the solution according to the invention which will be described in more detail in the following.

As already revealed, FIG. 1 shows the unit in a first mode of operation in which the material web is led along a first treatment path. On this first treatment path, both in the first coating station 8 as well as in the second coating station 25, the primary roll 10 and the secondary roll 11 are moved together and form a so-called roll gap into which the material web 1 is fed. The liquid medium is coated via the nozzle coating mechanism 13 onto the surface of the primary roll 10 which coats the liquid medium in the region of the roll gap onto the one side of the material web 1.

After passing the roll gap, the material web treated on one side in this manner is moved downstream of the first coating station 8 with the respectively treated side passed the IR-drier 15 and, downstream of the second coating station 25, passed the IR-drier 28.

This coating mode is generally denoted as so-called "indirect coating".

FIG. 2 shows the unit in the second mode of operation in which the material web 1 is led along a second treatment path. This second treatment path differs from the first treatment path according to FIG. 1 merely in terms of the guidance of the material web 1 in the region of the first coating station 8 and of the second coating station 25. As FIG. 2 shows, in both the first coating station 8 as well as in the second coating station 25, the secondary roll 11 is moved away from the primary roll 10 and the material web is no longer fed between the primary roll 10 and the secondary roll 11. Rather, the material web 1 is led along this second treatment path over a region of the shell surface of the primary roll 10 while faces away from the roll gap between the rolls 10 and 11. If desired, the nozzle coating mechanism 13 in FIG. 2 operates with a predosing blade. In this case, as illustrated, the precision dosing blade beam 14 is moved into its operational position. Otherwise, the guiding of the material web, in particular the run-in and the run-out of both coating stations is essentially the same with respect to direction.

The special feature of the arrangement according to the invention thus consists in that the respective general run-in and run-out direction of the material web 1 in the region of both coating stations is essentially the same along both treatment paths. This provides the initially described advantages in terms of the technical input relating to the guidance and feed of the material webs. It is merely necessary in this regard that the primary roll 10 of both coating stations can be driven in both directions, as already revealed, this being realizable without difficulty by means of simple and known techniques.

As already initially described, the material web 1 is led along the treatment path illustrated in FIG. 1 through a roll gap formed by the primary roll 10 and the secondary roll 11. This mode of operation reduces the risk of so-called web tears and leads to an increase in the so-called "running efficiency" but, as is known, must be paid for with a lower coating quality.

In the case of the second mode of operation according to FIG. 2, as is known, a high coating quality is guaranteed by the direct coating in the coating stations. However, this advantage must be bought with a greater risk of web tears.

A change over of the unit from the first mode of operation according to FIG. 1 to the second mode of operation according to FIG. 2 or vice versa is possible with a small work input. For this purpose, only the following steps are carried out:

a) A change in the rotational direction of the primary roll 10, the width tightening roll 7 and 24 as well as the web guide roll 9 (if present).

b) Removal of the nozzle coating mechanism 13.

c) Reassembly of the nozzle coating mechanism 13, namely:

c1) either after an ensuing change in direction of 180° (i.e. swapping of the guiding side and the driving side), c2) or relocation of the one nozzle coating mechanism from the second coating station 25 to the first coating station 8 and relocation of the other nozzle coating mechanism 13 from the first coating station 8 to the second coating station 25.

Figure 3:
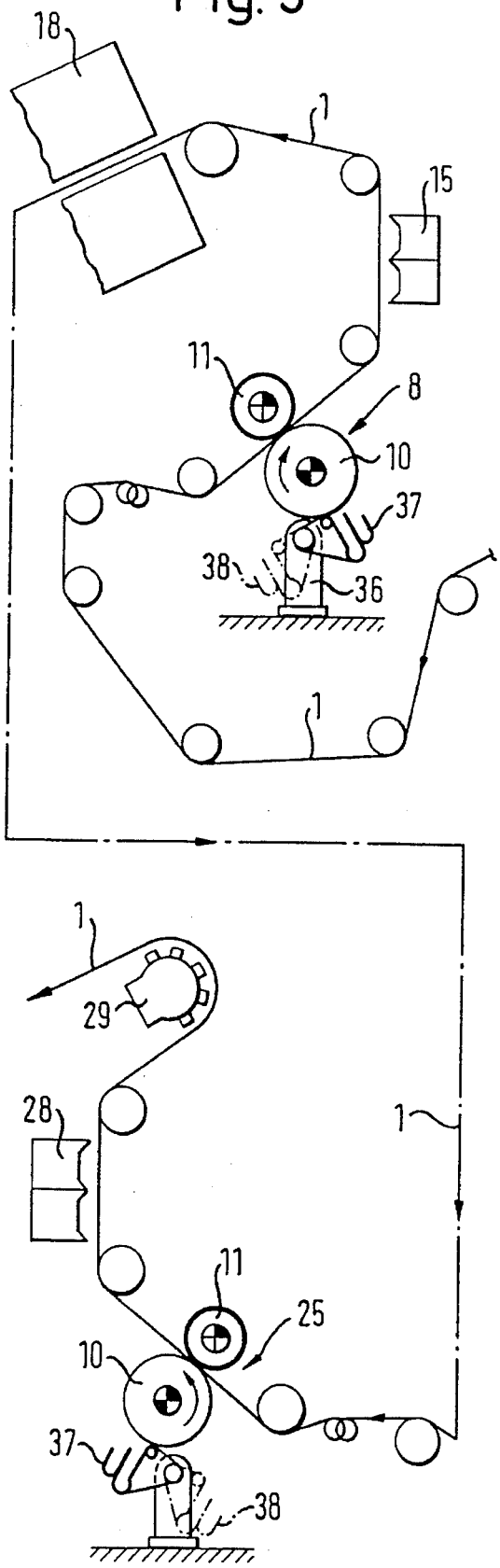
Figure 4:
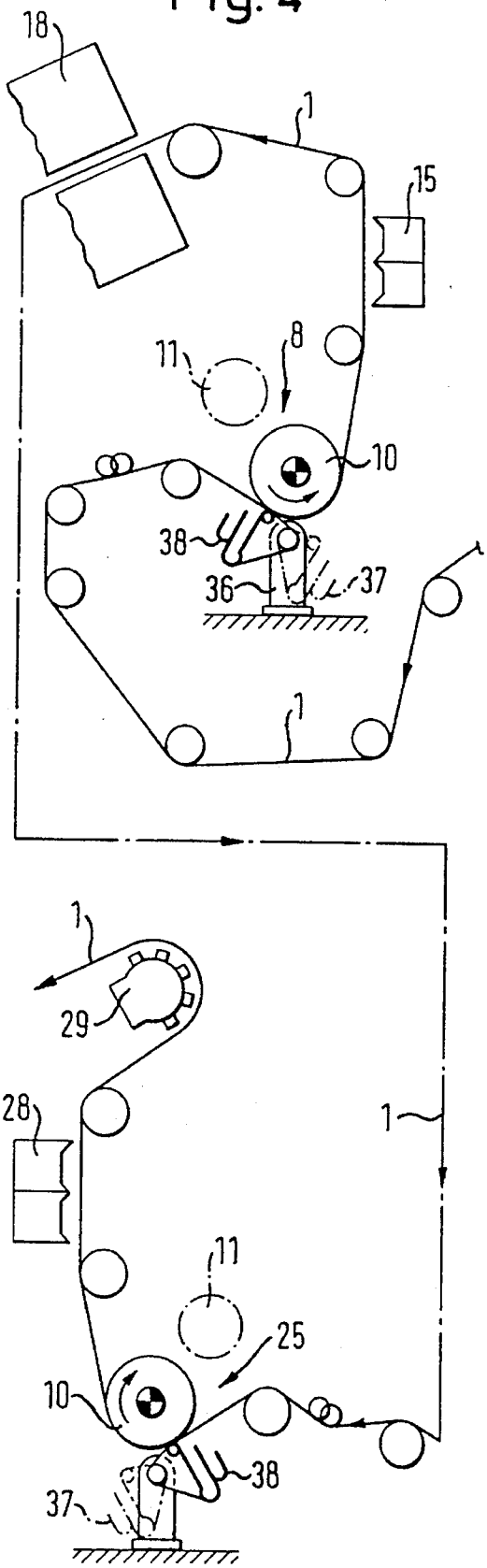
FIG. 4 shows the part of the entire unit illustrated in FIG. 3 with the different coating stations in a second mode of operation, FIG. 5 schematically shows a part of a further exemplary embodiment of an entire unit operating in a first mode of operation, and FIG. 6 schematically shows the exemplary embodiment according to FIG. 5 in a second mode of operation.

For clarity, in FIGS. 3 and 4, the illustration has been limited to the region of the first coating station 8 and the second coating station 25. Otherwise, the structure of the unit corresponds to the structure illustrated in FIGS. 1 and 2. The first contact drying cylinder arrangement 21, the second hot air drier 31 and the second contact drying cylinder arrangement 35 have merely been omitted for clarity.

Also in the case of the unit illustrated in the FIGS. 3 and 4, the material web can be led in a first mode of operation along a first treatment path (FIG. 3) and, in a second mode of operation, along a second treatment path (FIG. 4). On the first treatment path (FIG. 3), the liquid medium is coated "indirectly", i.e. by means of the primary roll 10 in the roll gap. On the second treatment path (FIG. 4), there ensues a "direct" coating of the liquid medium onto the material web analogously to the illustration in FIG. 2.

The difference to the exemplary embodiment illustrated in the FIGS. 1 and 2 consist merely in the structure of both of the coating stations 8 and 25. Both coating stations have a support device 36 on which the two nozzle coating mechanisms 37 and 38 are pivotably mounted opposite one another in a mirrored fashion. While the nozzle coating mechanism 37 is pivoted against the primary roll 10 in the case of "indirect coating" along the first treatment path (compare FIG. 3), the nozzle coating mechanism 38 is idle in the retracted position.

On the other hand, in the case of "direct coating" along the second treatment path according to FIG. 4, the nozzle coating mechanism 38 is in its operating position while the nozzle coating mechanism 37 is located in its retracted idle position.

Figure 5:
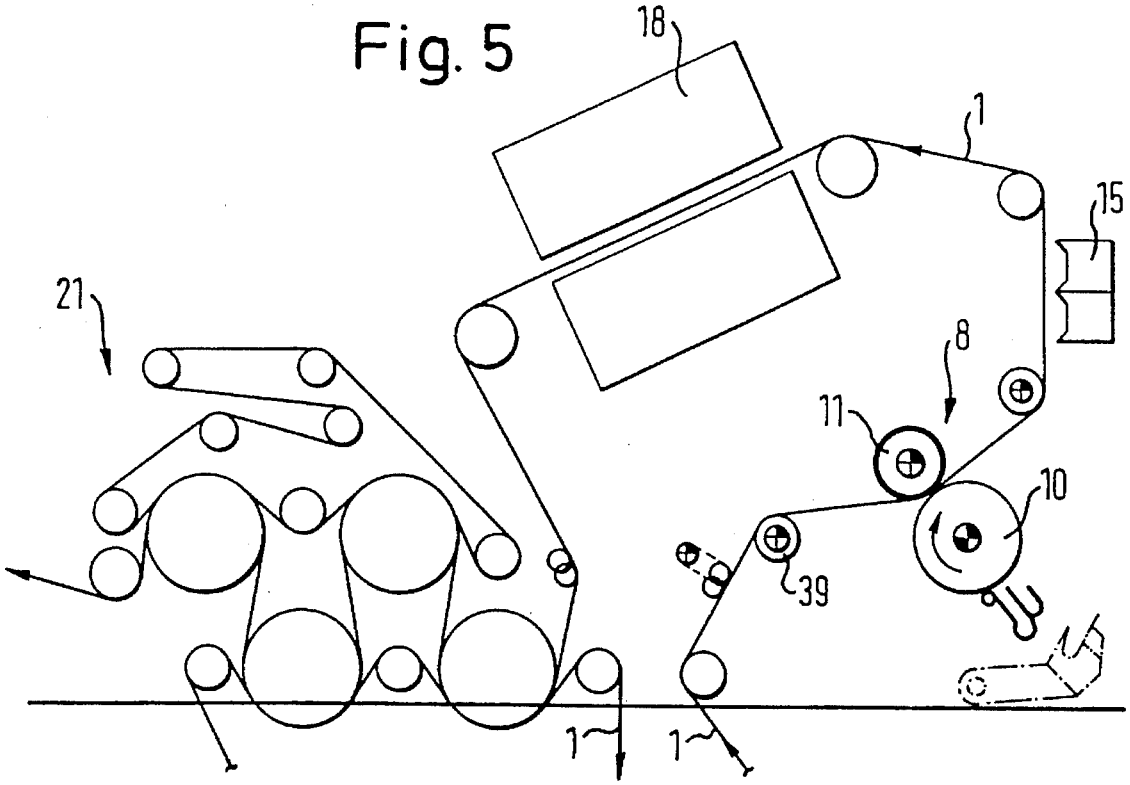
Figure 6:
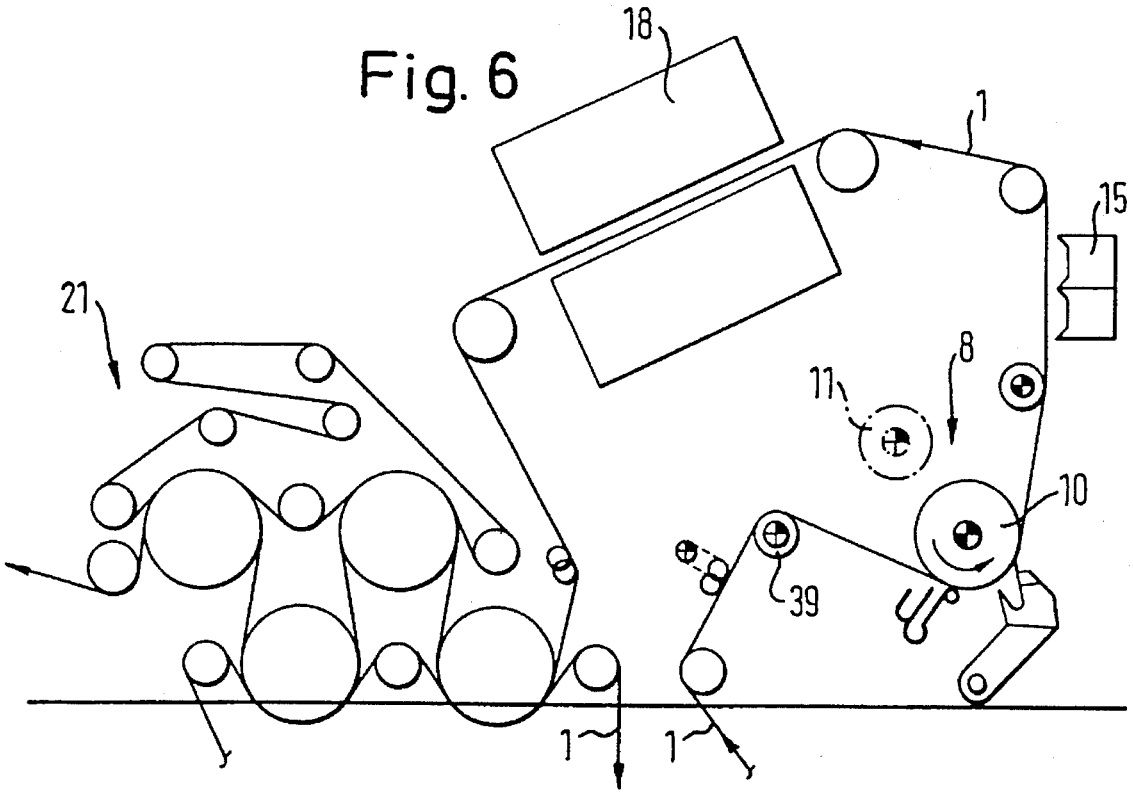

The further exemplary embodiment illustrated in the FIGS. 5 and 6 corresponds in terms of its essential structure to the exemplary embodiment according to the FIGS. 1 and 2. However, for better clarity, respectively only the first (upper) part of the entire unit is illustrated in the FIGS. 5 and 6. In other words, the FIGS. 5 and 6 merely show the first coating station 8 together with the first hot air drier 18 and the first contact drying cylinder arrangement 21. The illustration of the second coating station 25 and the devices of the unit following this has been omitted.

As also in the case of the previously described exemplary embodiment, in the unit illustrated in FIGS. 5 and 6, the material web can be led in a first mode of operation along a first treatment path (FIG. 5) and, in a second mode of operation, along a second treatment path (FIG. 6). The liquid medium is coated "indirectly" on the first treatment path (FIG. 5), and "directly" on the second treatment path (FIG. 6).

The only difference in comparison to the exemplary embodiment illustrated in FIGS. 1 and 2 consists in that the material web 1 only runs over the web guide roll 39 arranged upstream of the coating unit 8 in the same direction along both treatment paths so that the web guide roll 39 only needs to be driven in the one and same direction. This provides the advantage that, on the one hand, no means need to be provided for a change in rotational direction and, on the other hand, the treatment path in the region of this upstream web guide roll 39 always remains unchanged. When changing over from the first treatment path to the second treatment path or vice versa, a change of the web guidance is therefore not necessary. Additionally, it is not necessary during change-over to change the devices or the feed of the material webs in this region, which also provides advantages.

In all of the illustrated exemplary embodiments, the primary roll 10 and the secondary roll 11 are respectively directly provided at the upstream side with a web guide roll (9 or 39). In certain cases, instead of such a web guide roll, a so-called width tightening roll can be arranged upstream of the primary roll 10 and the secondary roll 11.

What is claimed is:

1. Method of coating at least one liquid medium onto a moving material web, in which method the material web is either led in a first mode of operation along a first treatment path or, in a second mode of operation, along a second treatment path, the material web being led a) along the first treatment path through a roll gap formed by a primary roll and a secondary roll to coat the liquid medium, or b) along the second treatment path over a region of a shell surface of the primary roll remote from the roll gap for directly coating the liquid medium onto the material web in this region of the shell surface of the primary roll, and wherein c) the primary roll is driven in one rotational direction in the first mode of operation and in an opposite rotational direction in the second mode of operation, characterized in that in both the first mode of operation and the second mode of operation coating of the liquid medium is performed by means of a nozzle coating mechanism;

in the first mode of operation along the first treatment path the liquid medium is coated via the nozzle coating mechanism onto the shell surface of the primary roll which in turn coats the liquid medium onto the material web in the roll gap formed between the primary roll and the secondary roll; and upon changing the mode of operation from the first mode of operation to the second mode of operation and vice versa, the nozzle coating mechanism is disassembled, changed in direction by moving the nozzle coating mechanism about 180° and subsequently reassembled.

2. Method according to claim 1, characterized in that a general run-in and run-out direction of the material web in the region of the primary and secondary rolls is essentially the same along both treatment paths.

3. Method according to claim 1, characterized in that the material web is led in each of the two modes of operation from the primary roll to a directly following web guide roll which touches the web side free of liquid medium and rotates in the same direction in each of the two modes of operation.

4. Method according to claim 1, characterized in that in each of the two modes of operation, the material web is led over a web guide roll arranged immediately upstream of the primary roll, the web guide roll rotating in the same rotational direction in each of the two modes of operation.

5. Method according to claim 1, characterized in that in each of the two modes of operation, the material web is led over a web guide roll arranged immediately upstream of the primary roll, the web guide roll rotating in the respectively opposite direction to the rotational direction of the primary roll in each of the two modes of operation.

6. Method according to claim 5, characterized in that a further web guide roll is arranged upstream of the web guide roll arranged upstream of the primary roll, the further web guide roll rotating respectively in the same rotational direction in both modes of operation.

7. Method according to claim 6, characterized in that a width tightening roll is provided between the upstream web guide roll and the further web guide roll, the width tightening roll rotating respectively in the same rotational direction as the primary roll in each of the two modes of operation.

8. Method of coating at least one liquid medium onto a moving material web, in which method the material web is either led in a first mode of operation along a first treatment path or, in a second mode of operation, along a second treatment path, the material web being led a) along the first treatment path through a roll gap formed by a primary roll and a secondary roll to coat the liquid medium, or b) along the second treatment path over a region of a shell surface of the primary roll remote from the roll gap for directly coating the liquid medium onto the material web in this region of the shell surface of the primary roll, and wherein c) the primary roll is driven in one rotational direction in the first mode of operation and in an opposite rotational direction in the second mode of operation, characterized in that in both the first mode of operation and the second mode of operation coating of the liquid medium is performed by means of a nozzle coating mechanism, the nozzle coating mechanism, the primary roll and the secondary roll forming a first coating station;

in the first mode of operation along the first treatment path the liquid medium is coated via the nozzle coating mechanism onto the shell surface of the primary roll which in turn coats the liquid medium onto the material web in the roll gap formed between the primary roll and the secondary roll; and upon changing the mode of operation from the first mode of operation to the second mode of operation and vice versa, the nozzle coating mechanism of the first coating station is disassembled and transferred to a second coating station for assembly therein, while a nozzle coating mechanism of the second coating station is disassembled and transferred to the first coating station and then assembled therein.

9. Method according to claim 8, characterized in that a general run-in and run-out direction of the material web in the region of the primary and secondary rolls is essentially the same along both treatment paths.

10. Method according to claim 8, characterized in that the material web is led in each of the two modes of operation from the primary roll to a directly following web guide roll which touches the web side free of liquid medium and rotates in the same direction in each of the two modes of operation.

11. Method according to claim 8, characterized in that in each of the two modes of operation, the material web is led over a web guide roll arranged immediately upstream of the primary roll, the web guide roll rotating in the same rotational direction in each of the two modes of operation.

12. Method according to claim 8, characterized in that in each of the two modes of operation, the material web is led over a web guide roll arranged immediately upstream of the primary roll, the web guide roll rotating in the respectively opposite direction to the rotational direction of the primary roll in each of the two modes of operation.

13. Method according to claim 12, characterized in that a further web guide roll is arranged upstream of the web guide roll arranged upstream of the primary roll, the further web guide roll rotating respectively in the same rotational direction in both modes of operation.

14. Method according to claim 13, characterized in that a width tightening roll is provided between the upstream web guide roll and the further web guide roll, the width tightening roll rotating respectively in the same rotational direction as the primary roll in each of the two modes of operation.

15. Apparatus for carrying out the method according to claim 1, wherein a coating station is associated with the treatment paths in the region of the primary roll and the secondary roll and comprises a coating mechanism for coating the liquid medium;

web guide rolls are provided for the run-in and the run-out of the material web;

a drive with a rotational direction reversal is provided for the primary roll (10); and the web guide rolls are arranged in such a manner in the run-in and run-out region of the primary roll (10) and the secondary roll (11) that they guide the material webs (1) along both treatment paths;

characterized in that the coating mechanism is a nozzle coating mechanism which is adapted to be disassembled from the coating station and to be subsequently reassembled into the coating station after having been turned about 180°.

16. Apparatus for carrying out the method according to claim 1, wherein a first coating station is associated with the treatment paths in the region of the primary roll and the secondary roll and comprises a coating mechanism for coating the liquid medium;

web guide rolls are provided for the run-in and the run-out of the material web;

a drive with a rotational direction reversal is provided for the primary roll (10); and the web guide rolls are arranged in such a manner in the run-in and run-out region of the primary roll (10) and the secondary roll (11) that they guide the material webs (1) along both treatment paths;

characterized in that the coating mechanism is a nozzle coating mechanism adapted to be disassembled from the first coating station for assembly into a second coating station, while a nozzle coating mechanism of a second coating station in turn is adapted to be disassembled from the second coating station for assembly into the first coating station.

* * * * *